US010184694B2

(12) United States Patent
Morie

(10) Patent No.: US 10,184,694 B2
(45) Date of Patent: Jan. 22, 2019

(54) CRYOGENIC REFRIGERATOR

(71) Applicant: SUMITOMO HEAVY INDUSTRIES, LTD., Tokyo (JP)

(72) Inventor: Takaaki Morie, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 82 days.

(21) Appl. No.: 14/838,265

(22) Filed: Aug. 27, 2015

(65) Prior Publication Data

US 2016/0061493 A1 Mar. 3, 2016

(30) Foreign Application Priority Data

Sep. 2, 2014 (JP) ..... 2014-177744

(51) Int. Cl.
*F25B 41/04* (2006.01)
*F25B 9/14* (2006.01)
*F25B 9/10* (2006.01)

(52) U.S. Cl.
CPC ..... *F25B 9/145* (2013.01); *F25B 9/10* (2013.01); *F25B 9/14* (2013.01); *F25B 41/04* (2013.01)

(58) Field of Classification Search
CPC .... F25B 31/023; F25B 2309/001; F25B 9/14; H02K 21/12; H02K 55/00; H02K 55/02; H02K 55/04
USPC ..... 62/6
See application file for complete search history.

(56) References Cited

U.S. PATENT DOCUMENTS 5,361,588 A * 11/1994 Asami ..... F25B 9/14 60/520
7,902,700 B1 * 3/2011 Gabrys ..... H02K 1/27 310/156.83
2007/0170803 A1 * 7/2007 Yabe ..... H02K 1/20 310/162
2011/0241455 A1 * 10/2011 Yoshida ..... H02K 1/12 310/44
2012/0165198 A1 * 6/2012 Mizutani ..... H02K 3/24 505/163
2013/0050871 A1 * 2/2013 Tamaoka ..... H02K 21/16 360/99.08

FOREIGN PATENT DOCUMENTS

JP 2003-047234 A 2/2003
JP 2007-194260 A 8/2007
JP 4247099 B2 1/2009
JP 2012-143041 A 7/2012
JP 2013-002687 A 1/2013

* cited by examiner

*Primary Examiner* — Keith Raymond
*Assistant Examiner* — Nael Babaa
(74) *Attorney, Agent, or Firm* — HEA Law PLLC

(57) ABSTRACT

In a cryogenic refrigerator, a valve switches between a flow passage of a low-pressure refrigerant gas and a flow passage of a high-pressure refrigerant gas. A motor drives the valve. The motor includes a rotor and a stator, the rotor located radially inward of the stator. A casing hermetically houses the rotor and the stator. The stator includes a back yoke and a magnetic member that acts as a magnetic path of an external magnetic field generated outside of the casing, the magnetic member located radially outward of and spaced apart from the back yoke. The magnetic member is hermetically housed in the casing.

13 Claims, 7 Drawing Sheets

FIG.7

| VOLUME RATIO OF LOW-PRESSURE REFRIGERANT GAS | TEMPERATURE OF HIGH-TEMPERATURE SIDE COOLING STAGE [K] | TEMPERATURE OF LOW-TEMPERATURE SIDE COOLING STAGE [K] | COP |
|---|---|---|---|
| 1.0 | 41.23 | 3.96 | 0.832 |
| 2.25 | 39.8 | 3.935 | 0.872 |

CRYOGENIC REFRIGERATOR

RELATED APPLICATION

Priority is claimed to Japanese Patent Application No. 2014-177744, filed on Sep. 2, 2014, the entire content of which is incorporated herein by reference.

BACKGROUND OF THE INVENTION

1. Field of the Invention

The present invention relates to a cryogenic refrigerator, and more particularly, to a cryogenic refrigerator suitable for cooling a superconducting coil.

2. Description of the Related Art

A Gifford-McMahon (GM) refrigerator or a pulse tube refrigerator is known as a refrigerator that generates cryogenic temperature. Such a refrigerator includes a valve that switches a flow of a high-pressure working gas and a low-pressure working gas, and a motor that drives the valve. Such a refrigerator is used for cooling, for example, a superconducting coil that generates a strong magnetic field.

SUMMARY OF THE INVENTION

A purpose of the present invention is to provide a technology for reducing influence of an external magnetic field exerted on a motor provided with a cryogenic refrigerator.

According to an embodiment of the present invention, a cryogenic refrigerator includes: a valve that switches between a flow passage of a low-pressure refrigerant gas and a flow passage of a high-pressure refrigerant gas; and a motor that drives the valve. The motor includes a rotor and a stator, the rotor located radially inward of the stator, and a casing that hermetically houses the rotor and the stator. The stator includes a back yoke and a magnetic member that acts as a magnetic path of an external magnetic field generated outside of the casing, the magnetic member located radially outward of and spaced apart from the back yoke. The magnetic member is hermetically housed in the casing.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which:

FIG. 7 is a diagram schematically illustrating a relationship between a volume of a part where a low-pressure refrigerant gas exists and a coefficient of performance in a tabular form.

DETAILED DESCRIPTION OF THE INVENTION

The invention will now be described by reference to the preferred embodiments. This does not intend to limit the scope of the present invention, but to exemplify the invention.

Generally, a motor is used as a power for driving a valve in a cryogenic refrigerator. For example, such a cryogenic refrigerator may be used together with a device using superconductivity and may be used for cooling a superconducting coil.

In the case of using the cryogenic refrigerator for cooling the superconducting coil, if a magnet motor is employed for the motor as the power for driving the valve, a torque of the motor may be reduced due to the influence of a magnetic field generated by the superconducting coil that is to be cooled. This may adversely affect the operation of the GM refrigerator.

Therefore, the cryogenic refrigerator according to an embodiment uses a motor having a magnetic path to guide an external magnetic field, so as to isolate aback yoke of the motor from the external magnetic field.

Figure 1:
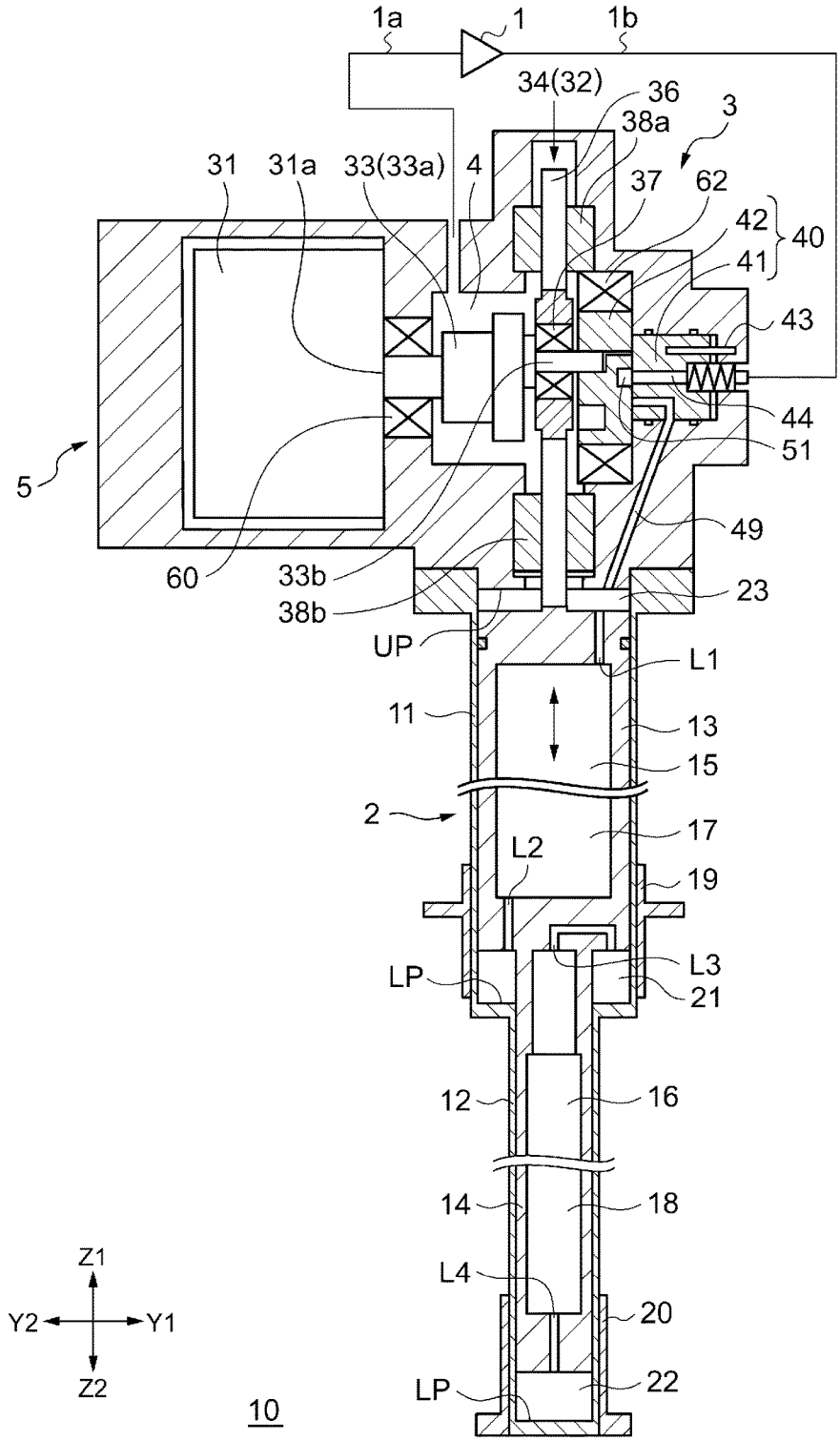
FIG. 1 is a cross-sectional view of a GM refrigerator according to an embodiment of the present invention.
Figure 2:
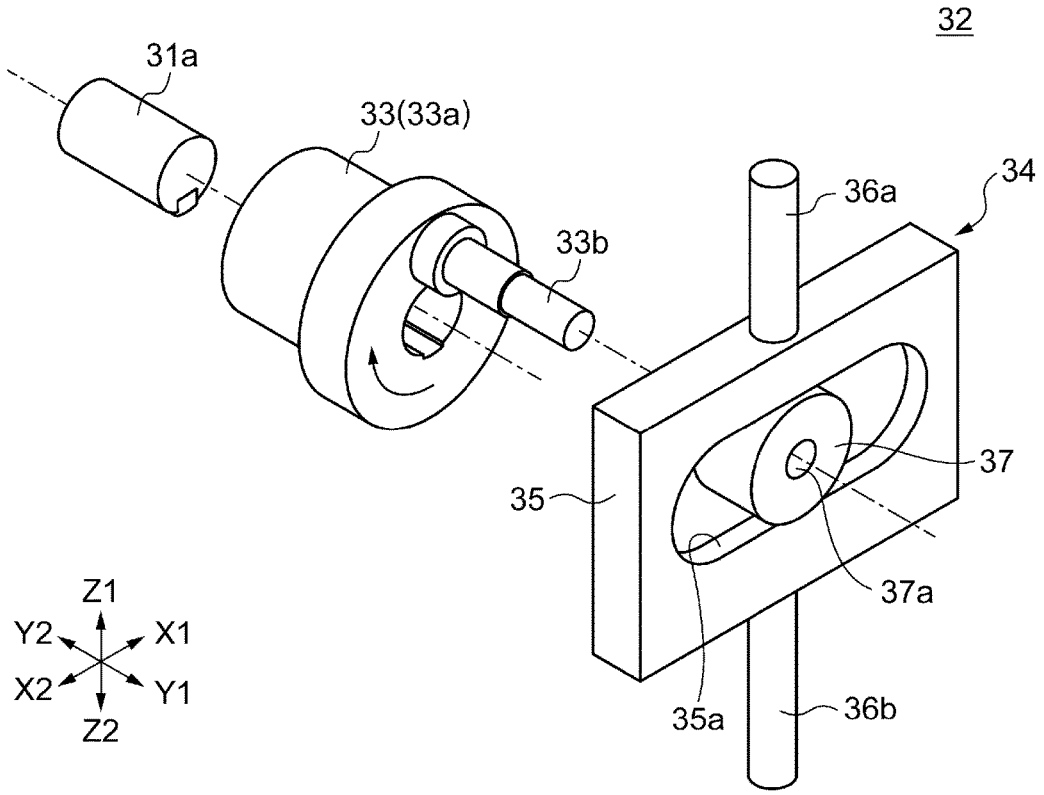
FIG. 2 is an enlarged exploded perspective view illustrating a scotch yoke mechanism.
Figure 3:
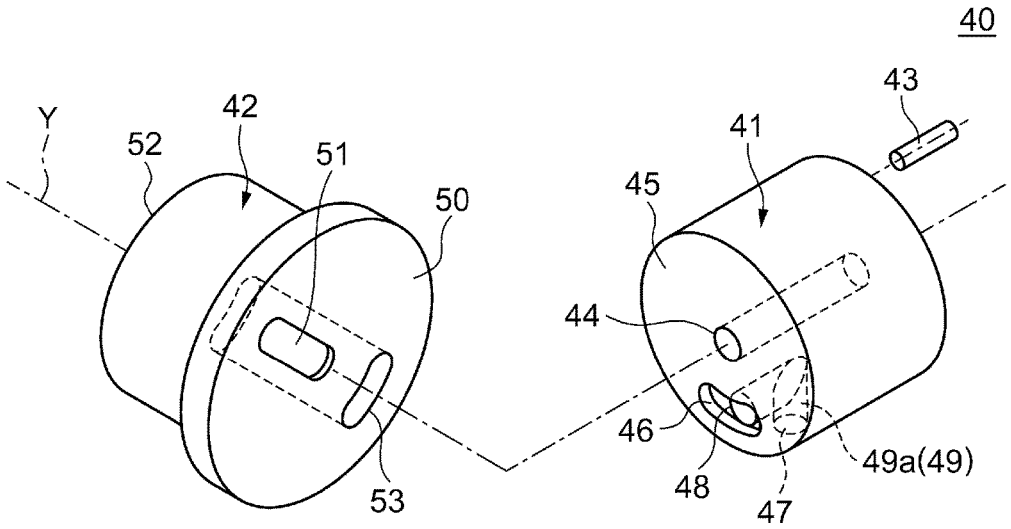
FIG. 3 is an enlarged exploded perspective view illustrating a rotary valve.

First, an entire configuration of a cryogenic refrigerator according to an embodiment will be described. FIGS. 1 to 3 are diagrams for explaining the cryogenic refrigerator according to an embodiment of the present invention. In the present embodiment, a Gifford-McMahon refrigerator (hereinafter referred to as a GM refrigerator 10) will be described as an example of the cryogenic refrigerator. However, the cryogenic refrigerator according to an embodiment is not limited to the GM refrigerator. The present invention can be applied to any type of cryogenic refrigerator using a motor for driving a valve and can be applied to, for example, a pulse tube refrigerator.

The GM refrigerator 10 according to the embodiment includes a compressor 1, a cylinder 2, a housing 3, a motor housing unit 5, etc.

The compressor 1 recovers a low-pressure refrigerant gas from its suction side to which a low-pressure pipe 1*a* is connected, compresses the low-pressure refrigerant gas, and supplies a high-pressure refrigerant gas to a high-pressure pipe 1*b* connected to the discharge side of the compressor 1. For example, a helium gas may be used as the refrigerant gas, but the refrigerant gas is not limited thereto.

The GM refrigerator 10 according to the embodiment is a two-stage GM refrigerator. In the two-stage GM refrigerator 10, the cylinder 2 has two sub-cylinders: a high-temperature side cylinder 11 and a low-temperature side cylinder 12. A high-temperature side displacer 13 is inserted inside the high-temperature side cylinder 11. Also, a low-temperature side displacer 14 is inserted inside the low-temperature side cylinder 12.

The high-temperature side displacer 13 and the low-temperature side displacer 14 are connected to each other and are configured to be able to reciprocate in the cylinder axial direction inside the high-temperature side cylinder 11 and the low-temperature side cylinder 12, respectively. A high-temperature side internal space 15 and a low-temperature side internal space 16 are formed inside the high-temperature side displacer 13 and the low-temperature side displacer 14, respectively. The high-temperature side internal space 15 and the low-temperature side internal space 16 are filled with regenerator materials and function as a high-temperature side regenerator 17 and a low-temperature side regenerator 18, respectively.

The high-temperature side displacer 13 located at the upper part is connected to a drive shaft 36 extending upward (in a Z1 direction). This drive shaft 36 forms part of a scotch yoke mechanism 32 described later.

A gas flow passage L1 is formed on a high-temperature end side (at an end portion on the side of the Z1 direction) of the high-temperature side displacer 13. Further, a gas flow passage L2 that allows the high-temperature side internal space 15 to communicate with a high-temperature side expansion space 21 is formed on a low-temperature end side (at an end portion on the side of a Z2 direction) of the high-temperature side displacer 13.

The high-temperature side expansion space 21 is formed at an end portion on the low-temperature side of the high-temperature side cylinder 11 (end portion on the side of the direction indicated by an arrow Z2 in FIG. 1). Further, an upper chamber 23 is formed at an end portion on the high-temperature side of the high-temperature side cylinder 11 (end portion on the side of the direction indicated by an arrow Z1 in FIG. 1).

Further, a low-temperature side expansion space 22 is formed at an end portion on the low-temperature side inside the low-temperature side cylinder 12 (end portion on the side of the direction indicated by the arrow Z2 in FIG. 1).

The low-temperature side displacer 14 is attached to a lower portion of the high-temperature side displacer 13 by a joint mechanism that is not illustrated. A gas flow passage L3 that allows the high-temperature side expansion space 21 to communicate with the low-temperature side internal space 16 is formed at an end portion on the high-temperature side (end portion on the side of the direction indicated by the arrow Z1 in FIG. 1) of this low-temperature side displacer 14. Further, a gas flow passage L4 that allows the low-temperature side internal space 16 to communicate with the low-temperature side expansion space 22 is formed at an end portion on the low-temperature side (end portion on the side of the direction indicated by the arrow Z2 in FIG. 1) of the low-temperature side displacer 14.

A high-temperature side cooling stage 19 is disposed at a position facing the high-temperature side expansion space 21 on an outer peripheral surface of the high-temperature side cylinder 11. Further, a low-temperature side cooling stage 20 is disposed at a position facing the low-temperature side expansion space 22 on an outer peripheral surface of the low-temperature side cylinder 12.

The above-mentioned high-temperature side displacer 13 and low-temperature side displacer 14 move in a vertical direction in the figure (in the directions of the arrows Z1 and Z2) inside the high-temperature side cylinder 11 and the low-temperature side cylinder 12, respectively, by means of the scotch yoke mechanism 32.

As shown in FIG. 1, the housing 3 has a rotary valve 40, etc., and the motor housing unit 5 houses a motor 31.

The motor 31, a driving rotary shaft 31*a*, and the scotch yoke mechanism 32 form a drive unit. The motor 31 generates rotational driving force, and a rotary shaft (hereafter referred to as "driving rotary shaft 31*a*") that is connected to the motor 31 transmits the rotary motion of the motor 31 to the scotch yoke mechanism 32. The driving rotary shaft 31*a* is supported by a bearing 60.

FIG. 2 illustrates the scotch yoke mechanism 32 that is enlarged. The scotch yoke mechanism 32 has a crank 33, a scotch yoke 34, etc. This scotch yoke mechanism 32 can be driven by a driving means, for example, a motor 31 or the like.

The crank 33 is fixed to the driving rotary shaft 31*a*. The crank 33 is configured such that a crank pin 33*b* is provided at a position eccentric from a position where the driving rotary shaft 31*a* is attached. Therefore, when the crank 33 is attached to the driving rotary shaft 31*a*, the crank pin 33*b* becomes eccentric with respect to the driving rotary shaft 31*a*. In this sense, the crank pin 33*b* functions as an eccentric rotating body. The driving rotary shaft 31*a* may be rotatably supported at a plurality of sites in a longitudinal direction thereof.

The scotch yoke 34 has a drive shaft 36*a*, a drive shaft 36*b*, a yoke plate 35, a roller bearing 37, etc. A housing space is formed inside the housing 3. This housing space is formed as a gastight container having gastightness that houses the scotch yoke 34, a rotor valve 42 of the rotary valve 40 described below, and so on. The housing space inside the housing 3 is hereinafter referred to as "gastight container 4" in the present specification. The gastight container 4 communicates with the suction port of the compressor 1 via the low-pressure pipe 1*a*. Therefore, the low pressure is always maintained within the gastight container 4.

The drive shaft 36*a* extends upward (in the Z1 direction) from the yoke plate 35. This drive shaft 36*a* is supported by a sliding bearing 38*a* provided inside the housing 3. Therefore, the drive shaft 36*a* is configured to be movable in the vertical direction in the figure (in the directions of the arrows Z1 and Z2 in the figure).

The drive shaft 36*b* extends downward (in the Z2 direction) from the yoke plate 35. This drive shaft 36*b* is supported by a sliding bearing 38*b* provided inside the housing 3. Therefore, the drive shaft 36 is also configured to be movable in the vertical direction in the figure (in the directions of the arrows Z1 and Z2 in the figure).

Since the drive shaft 36*a* and the drive shaft 36*b* are supported by the sliding bearing 38*a* and the sliding bearing 38*b*, respectively, the scotch yoke 34 is configured to be movable in the vertical direction (in the directions of the arrows Z1 and Z2 in the figure) inside the housing 3.

It should be noted that a term "shaft direction" may be used to clearly express a positional relationship of the components of the cryogenic refrigerator in the present embodiment. The shaft direction is a direction in which the drive shaft 36*a* and the drive shaft 36*b* extend and conforms to the direction in which the high-temperature side displacer 13 and the low-temperature side displacer 14 move. For the sake of convenience, relative closeness to the expansion space or the cooling stage may be referred to as "lower" or "downward" and relative remoteness therefrom may be referred to as "upper" or "upward" in relation to the shaft direction. In other words, relative remoteness from the end portion of the low-temperature side may be referred to as "upper" or "upward," and relative closeness thereto may be referred to as "lower" or "downward." It should be noted that these expressions are irrespective of arrangement occurring when the GM refrigerator 10 is mounted. For example, the GM refrigerator 10 may be mounted while having the expansion space directed upward in the vertical direction.

A horizontally long window 35*a* is formed on the yoke plate 35. This horizontally long window 35*a* extends in a direction that intersects with the direction in which the drive shaft 36*a* and the drive shaft 36*b* extend, for example, in an orthogonal direction (directions of arrows X1 and X2 in FIG. 2).

The roller bearing 37 is disposed inside this horizontally long window 35*a*. The roller bearing 37 is configured to be rollable inside the horizontally long window 35*a*. Further, a hole 37*a* to be engaged with the crank pin 33*b* is formed at a center position of the roller bearing 37. The horizontally long window 35*a* permits lateral movement of the crank pin 33*b* and the roller bearing 37. The horizontally long window 35*a* includes an upper frame and a lower frame that extend in the lateral direction, and further includes a first side frame and a second side frame that extend in the shaft direction or the longitudinal direction at respective lateral end portions of the upper frame and the lower frame and that connect the upper frame with the lower frame.

When the motor 31 is driven such that the driving rotary shaft 31*a* rotates, the crank pin 33*b* rotates to draw a circle. With this movement, the scotch yoke 34 reciprocates in the directions of the arrows Z1 and Z2 in the figure. Concurrently, the roller bearing 37 reciprocates in the direction of the arrows X1 and X2 in the figure inside the horizontally long window 35*a*.

The high-temperature side displacer 13 is connected to the drive shaft 36*b* disposed at a lower portion of the scotch yoke 34. Therefore, when the scotch yoke 34 reciprocates in the directions of the arrows Z1 and Z2 in the figure, the high-temperature side displacer 13 and the low-temperature side displacer 14 connected thereto also reciprocate in the directions of the arrows Z1 and Z2 inside the high-temperature side cylinder 11 and the low-temperature side cylinder 12, respectively.

A valve mechanism will be described now. The GM refrigerator 10 according to the embodiment uses the rotary valve 40 as the valve mechanism.

The rotary valve 40 switches between the flow passage of the low-pressure refrigerant gas and the flow passage of the high-pressure refrigerant gas. The rotary valve 40 is driven by the motor 31. The rotary valve 40 functions as a supply valve that guides a high-pressure refrigerant gas discharged from the discharge side of the compressor 1 to the upper chamber 23 of the high-temperature side displacer 13 and also functions as an exhaust valve that guides the refrigerant gas from the upper chamber 23 to the suction side of the compressor 1.

This rotary valve 40 has a stator valve 41 and a rotor valve 42 as shown in FIG. 3 as well as in FIG. 1. The stator valve 41 has a flat stator-side sliding surface 45, and the rotor valve 42 also has a flat rotor-side sliding surface 50. When this stator-side sliding surface 45 and the rotor-side sliding surface 50 are brought into surface contact with each other, the refrigerant gas is prevented from leaking.

The stator valve 41 is fixed inside the housing 3 by a fixing pin 43. When the stator valve 41 is fixed using this fixing pin 43, the rotation of the stator valve 41 is restricted.

The rotor valve 42 is rotatably supported by a rotor valve bearing 62. An engaging hole (not illustrated) to be engaged with the crank pin 33*b* is formed on an opposite-side end surface 52 located on the side of the rotor valve 42 opposite to the rotor-side sliding surface 50. A tip portion of the crank pin 33*b* projects from the roller bearing 37 in a direction of an arrow Y1 when the crankpin 33*b* is inserted into the roller bearing (see FIG. 1).

The tip portion of the crank pin 33*b* projecting from the roller bearing 37 is engaged with the engaging hole formed on the rotor valve 42. Therefore, the rotor valve 42 rotates in synchronization with the reciprocation of the scotch yoke 34 when the crank pin 33*b* rotates (eccentrically rotates).

The stator valve 41 has a refrigerant gas supply hole 44, an arc-shaped groove 46, and a gas flow passage 49. The refrigerant gas supply hole 44 is connected to the high-pressure pipe 1*b* of the compressor 1 and is formed such that the refrigerant gas supply hole 44 penetrates a center portion of the stator valve 41.

The arc-shaped groove 46 is formed on the stator-side sliding surface 45. The arc-shaped groove 46 has an arc shape that centers the refrigerant gas supply hole 44.

The gas flow passage 49 is formed through both the stator valve 41 and the housing 3. One end portion of the gas flow passage 49 on the valve is open into the arc-shaped groove 46 to form an opening 48. The gas flow passage 49 has a discharge port 47 that is open on the side surface of the stator valve 41. The discharge port 47 communicates with the part of the gas flow passage 49 inside the housing. Further, the other end portion of the gas flow passage 49 inside the housing is connected to the high-temperature side expansion space 21 via the upper chamber 23, the gas flow passage L1, the high-temperature side regenerator 17, and so on.

The rotor valve 42 has an oval-shaped or elongate groove 51 and an arc-shaped hole 53.

The oval-shaped groove 51 is formed on the rotor-side sliding surface 50 such that the oval-shaped groove 51 extends in the radial direction from the center of the rotor-side sliding surface 50. The arc-shaped hole 53 penetrates the rotor valve 42 from the rotor-side sliding surface 50 to the opposite-side end surface 52 and is connected to the gastight container 4. The arc-shaped hole 53 is formed such that the arc-shaped hole 53 is positioned on the same circumference as the arc-shaped groove 46 of the stator valve 41.

A supply valve is formed of the refrigerant gas supply hole 44, the oval-shaped groove 51, the arc-shaped groove 46, and the opening 48. Further, an exhaust valve is formed of the opening 48, the arc-shaped groove 46, and the arc-shaped hole 53. In the present embodiment, cavities that exist inside the valve such as the oval-shaped groove 51 and the arc-shaped groove 46 may be collectively referred to as a valve internal space.

In the GM refrigerator 10 configured as above, the scotch yoke 34 reciprocates in the Z1 and Z2 directions when the rotational driving force of the motor 31 is transmitted to the scotch yoke mechanism 32 via the driving rotary shaft 31*a* while causing the scotch yoke mechanism 32 to be driven. Due to this movement of the scotch yoke 34, the high-temperature side displacer 13 and the low-temperature side displacer 14 reciprocate between a bottom dead center LP and a top dead center UP inside the high-temperature side cylinder 11 and the low-temperature side cylinder 12, respectively.

Before the high-temperature side displacer 13 and the low-temperature side displacer 14 reach the bottom dead center LP, the exhaust valve closes. Then the supply valve opens. In other words, a refrigerant gas flow passage is formed via the refrigerant gas supply hole 44, the oval-shaped groove 51, the arc-shaped groove 46, and the gas flow passage 49.

Therefore, the high-pressure refrigerant gas from the compressor 1 starts filling the upper chamber 23. Subsequently, the high-temperature side displacer 13 and the low-temperature side displacer 14 pass the bottom dead center LP and start moving upward, and the refrigerant gas passes the high-temperature side regenerator 17 and the low-temperature side regenerator 18 from the upper side to the lower side, filling the high-temperature side expansion space 21 and the low-temperature side expansion space 22, respectively.

When the high-temperature side displacer 13 and the low-temperature side displacer 14 reach the top dead center UP, the supply valve closes. At the same time or subsequently, the exhaust valve opens. In other words, a refrigerant gas flow passage is formed via the gas flow passage 49, the arc-shaped groove 46, and the arc-shaped hole 53.

Due to this, the high-pressure refrigerant gas expands inside the high-temperature side expansion space 21 and the low-temperature side expansion space 22, thereby generating cold and cooling the high-temperature side cooling stage 19 and the low-temperature side cooling stage 20. Further, a low-temperature refrigerant gas that has generated cold flows from the lower side to the upper side while cooling the regenerator materials inside the high-temperature side regenerator 17 and the low-temperature side regenerator 18 and then flows back to the low-pressure pipe la of the compressor 1.

Then, before the high-temperature side displacer 13 and the low-temperature side displacer 14 reach the bottom dead center LP, the exhaust valve closes, and the supply valve opens, ending one cycle. By repeating the cycle of compression and expansion of the refrigerant gas in this manner, the high-temperature side cooling stage 19 and the low-temperature side cooling stage 20 of the GM refrigerator 10 are cooled to a cryogenic temperature. The high-temperature side cooling stage 19 and the low-temperature side cooling stage 20 of the GM refrigerator 10 conduct the cold generated by the expansion of the refrigerant gas inside the high-temperature side expansion space 21 and the low-temperature side expansion space 22 to the outside of the high-temperature side cylinder 11 and the low-temperature side cylinder 12, respectively.

According to the embodiment as described above, the GM refrigerator 10 generates cold by converting the driving force of the drive unit such as the motor 31 to reciprocating movement of the high-temperature side displacer 13 and the low-temperature side displacer 14. Thereby, the temperature of the low-temperature side cooling stage 20 becomes a cryogenic temperature of approximately 4K.

As an example of the cooling target of the GM refrigerator 10 according to the embodiment, there is a superconducting coil. Generally, the superconducting coil is used for generating a strong magnetic field. Therefore, when the GM refrigerator 10 is used for cooling the superconducting coil, the motor 31 also experiences the magnetic field generated by the superconducting coil.

Figure 4:
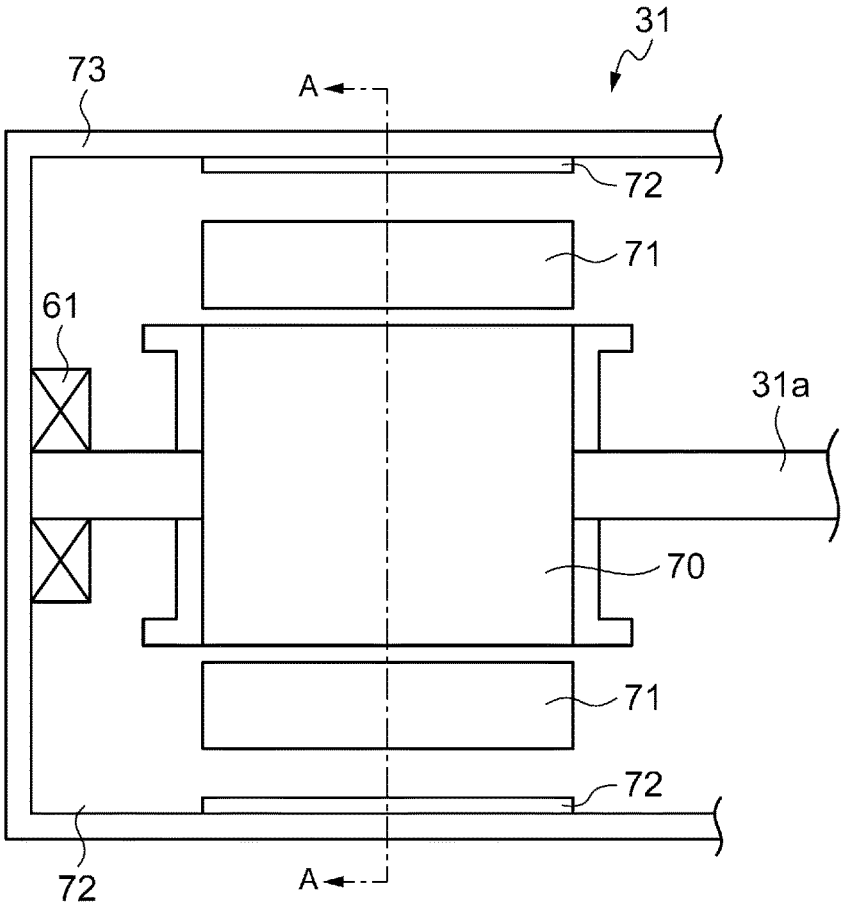
FIG. 4 is a diagram schematically illustrating the internal configuration of a motor according to an embodiment.

FIG. 4 is a diagram schematically illustrating the internal configuration of the motor 31 according to the embodiment. The motor 31 includes a rotor 70, a stator 71, a magnetic member 72, a driving rotary shaft 31*a* , a bearing 61, and a casing 73 that hermetically houses these members. In the motor 31 according to the embodiment, the stator 71 is disposed around the rotor 70. That is, the rotor 70 is provided inside the stator 71 in the radial direction, and the driving rotary shaft 31*a* penetrates the center of the rotor 70. Although details will be described below, the magnetic member 72 is disposed outside the stator 71 in the radial direction.

Figure 5B:
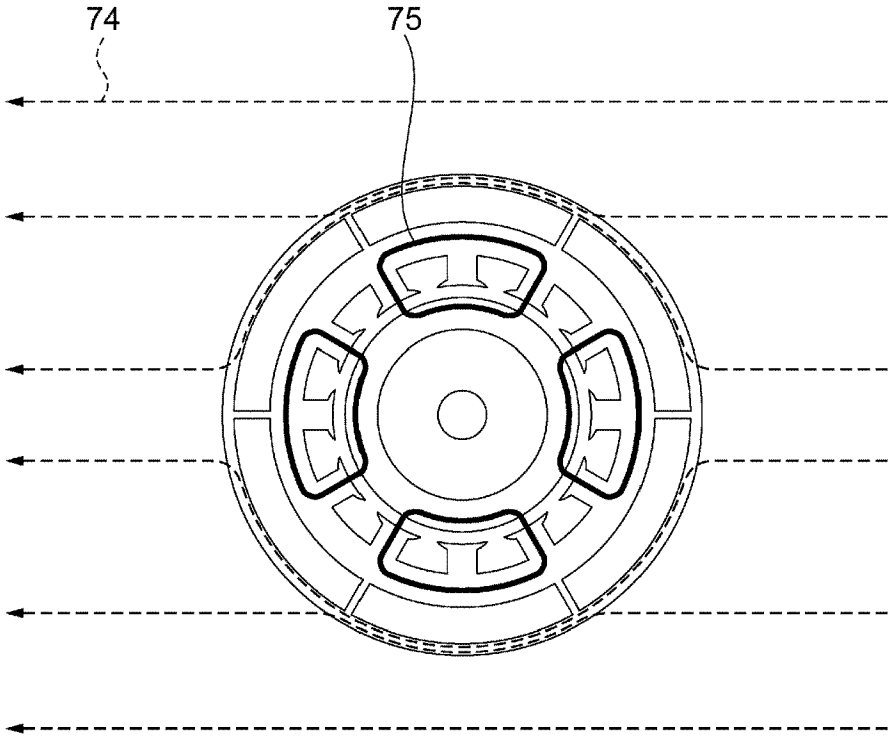
FIGS. 5A and 5B are diagrams for explaining a flow of an external magnetic field in the inside of the motor according to the embodiment.
Figure 5A:
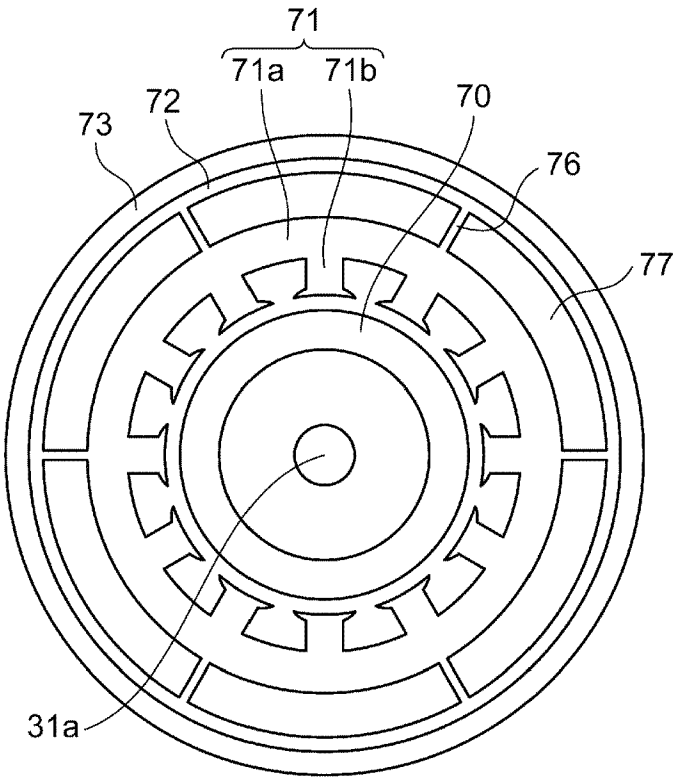

FIGS. 5A and 5B are diagrams for explaining the flows of the magnetic field in the inside of the motor 31 according to the embodiment.

FIG. 5A is a diagram schematically illustrating the cross-section when the motor 31 according to the embodiment is cut out by a plane perpendicular to the driving rotary shaft 31*a* , and is a cross-sectional view taken along line A-A of FIG. 4. As shown in FIG. 5A, the stator 71 includes an annular back yoke 71*a* and a plurality of teeth 71*b* formed inside the back yoke in the radial direction. The magnetic member 72 is disposed at a position spaced apart from the back yoke 71*a* in the outside of the back yoke 71*a* in the radial direction. As in the stator 71 or the rotor 70, the magnetic member 72 is hermetically housed inside the casing 73.

In the example shown in FIG. 5A, the back yoke 71*a* and the magnetic member 72 are directly connected to each other via a connecting member 76. More specifically, the stator 71, the magnetic member 72, and the connecting member 76 are formed of a laminated steel plate member, and each layer constituting the laminated steel plate member is integrally formed by performing a punching process to include the back yoke 71*a*, the teeth 71*b*, and the magnetic member 72. Thereby, the back yoke 71*a* and the magnetic member 72 are fixed such that the relative position therebetween is unchanged. Therefore, it can be considered that the magnetic member 72 constitutes part of the stator 71.

FIG. 5B is a diagram illustrating an external magnetic field 74 and an internal magnetic field 75 in the motor 31. In FIG. 5B, dashed lines represent the flow of the external magnetic field 74 generated in the outside of the casing 73. Thick solid lines represent the flow of the internal magnetic field 75 that causes the driving force of the motor 31. The external magnetic field 74 is a magnetic field generated by, for example, the superconducting coil that is the cooling target of the GM refrigerator 10. In FIG. 5B, the illustration of the casing 73 is omitted in order to avoid being complicated.

As shown in FIG. 5B, the internal magnetic field 75 of the motor 31 forms a loop-shaped magnetic path via the back yoke 71*a*, the teeth 71*b*, and the rotor 70. Since the back yoke 71*a* and the magnetic member 72 are separated from each other, the internal magnetic field 75 of the motor 31 is substantially blocked from the magnetic member 72.

As shown in FIG. 5B, the magnetic member 72 becomes a magnetic path of the external magnetic field 74 generated in the outside of the casing 73. Therefore, most of the external magnetic field 74 is induced to the magnetic member 72 and is blocked from the back yoke 71*a*. As such, the external magnetic field 74 does not almost interfere with the internal magnetic field 75 of the motor 31. That is, it is possible to prevent the external magnetic field 74 of the motor from being affected on the output torque of the motor 31.

Figure 6B:
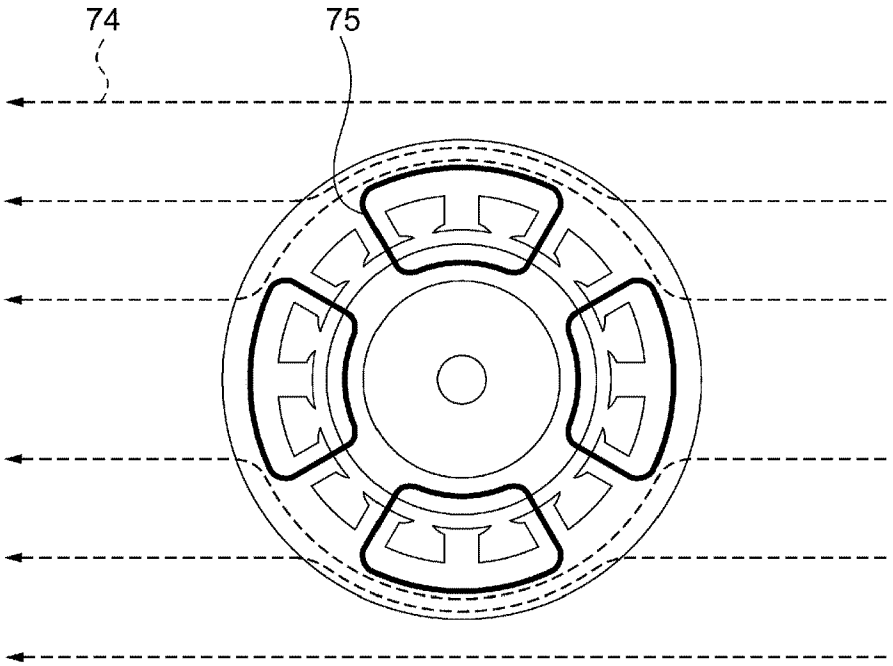
FIGS. 6A and 6B are diagrams for explaining a flow of a magnetic field in the inside of a motor according to a comparative example of the embodiment.
Figure 6A:
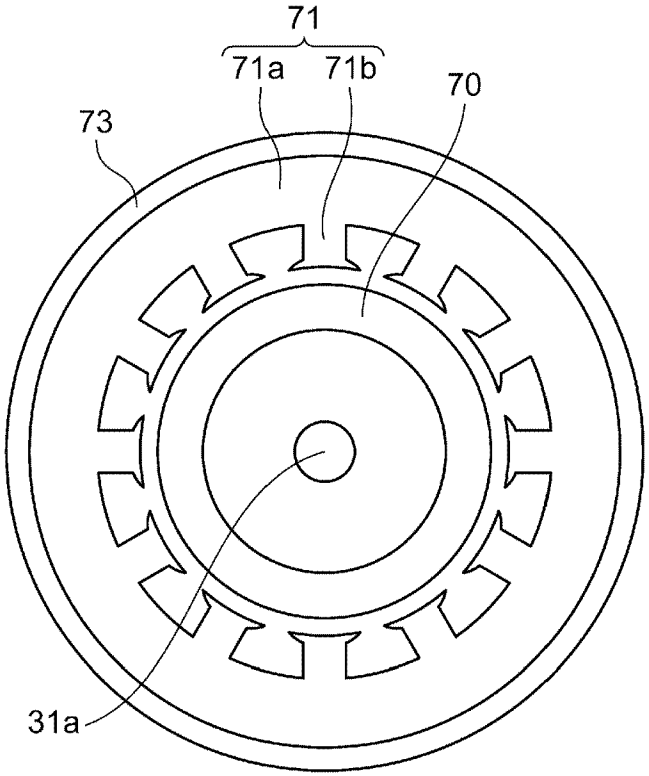

FIGS. 6A and 6B are diagrams for explaining the flows of a magnetic field in the inside of a motor according to a comparative example of the embodiment.

FIG. 6A is a diagram schematically illustrating the cross-section when the motor according to the comparative example is cut out by a plane perpendicular to a driving rotary shaft and is a diagram corresponding to FIG. 5A. As shown in FIG. 6A, in the motor according to the comparative example, a back yoke 71*a*, teeth 71*b*, and a rotor 70 are housed in a casing 73. However, the motor according to the comparative example does not include a magnetic member 72 unlike the motor 31 according to the embodiment.

FIG. 6B is a diagram illustrating an external magnetic field 74 and an internal magnetic field 75 in the motor according to the comparative example. As shown in FIG. 6B, in the motor according to the comparative example, the external magnetic field 74 passes through the back yoke 71*a* that is the magnetic path of the internal magnetic field 75. Therefore, the external magnetic field 74 interferes with the internal magnetic field 75 and may be a factor that reduces the output torque of the motor. If the output torque of the motor is less than a torque required for reciprocating movement of a high-temperature side displacer 13 and a low-temperature side displacer 14, the GM refrigerator 10 may not normally operate. The magnetic member 72 included in the motor 31 according to the embodiment can prevent such an external magnetic field 74 from interfering with the operation of the motor 31. In FIG. 6B, the illustration of the casing 73 is omitted in order to avoid being complicated, as in FIG. 5B.

The following returns to the description of FIG. 5. A region 77 between the back yoke 71*a* and the magnetic member 72 may be filled with a non-magnetic material. For example, a metal such as stainless steel, copper, aluminum, and the like, or a resin such as G-FRP, epoxy, and the like can be used. From the viewpoint of the weight reduction, the resin is preferable. Alternatively, the region 77 may be a hollow space. In this case, it is preferable that the region 77 communicate with the above-described gastight container 4. Since the gastight container 4 communicates with the suction port of the compressor 1 via the low-pressure pipe 1*a*, the region 77 is also a space that communicates with the flow passage of the low-pressure refrigerant gas.

In the GM refrigerator 10 according to the embodiment, since the region 77 between the back yoke 71*a* and the magnetic member 72 is hollow, the volume of the part of the GM refrigerator 10 where the low-pressure refrigerant gas exists increases. The inventors of the present application have conducted the experiments and found that the coefficient of performance (COP) of the GM refrigerator 10 was improved by increasing the volume of the part of the GM refrigerator 10 where the low-pressure refrigerant gas existed.

FIG. 7 is a diagram schematically illustrating the relationship between the volume of the part where the low-pressure refrigerant gas exists and the coefficient of performance in a tabular form. The inventors of the present application has conducted the experiments of increasing the volume of the part where the low-pressure refrigerant gas existed in the GM refrigerator 10 in which the temperature of the high-temperature side cooling stage 19 was 41.23 [K], the temperature of the low-temperature side cooling stage 20 was 3.96 [K], and the coefficient of performance was 0.832. Specifically, when the volume of the part where the low-pressure refrigerant gas existed was increased 2.25 times, the temperature of the high-temperature side cooling stage 19 was improved to 39.8 [K], the temperature of the low-temperature side cooling stage 20 was improved to 3.935 [K], and the coefficient of performance was improved to 0.872.

From the above experiments, the performance of the GM refrigerator 10 can be improved by communicating the hollow region 77 between the back yoke 71*a* and the magnetic member 72 with the gastight container 4.

As described above, the GM refrigerator 10 according to the embodiment can reduce the influence of the external magnetic field 74 that is exerted to the motor 31 provided in the GM refrigerator 10. Further, the performance of the GM refrigerator 10 can be improved by communicating the hollow region 77 between the back yoke 71*a* and the magnetic member 72 with the gastight container 4.

While the present invention has been described based on the embodiment, the embodiment is merely illustrative of the principles and applications of the present invention. Additionally, many variations and changes in arrangement may be made in the embodiment without departing from the spirit of the present invention as defined by the appended claims.

First Modification

Figure 8A:
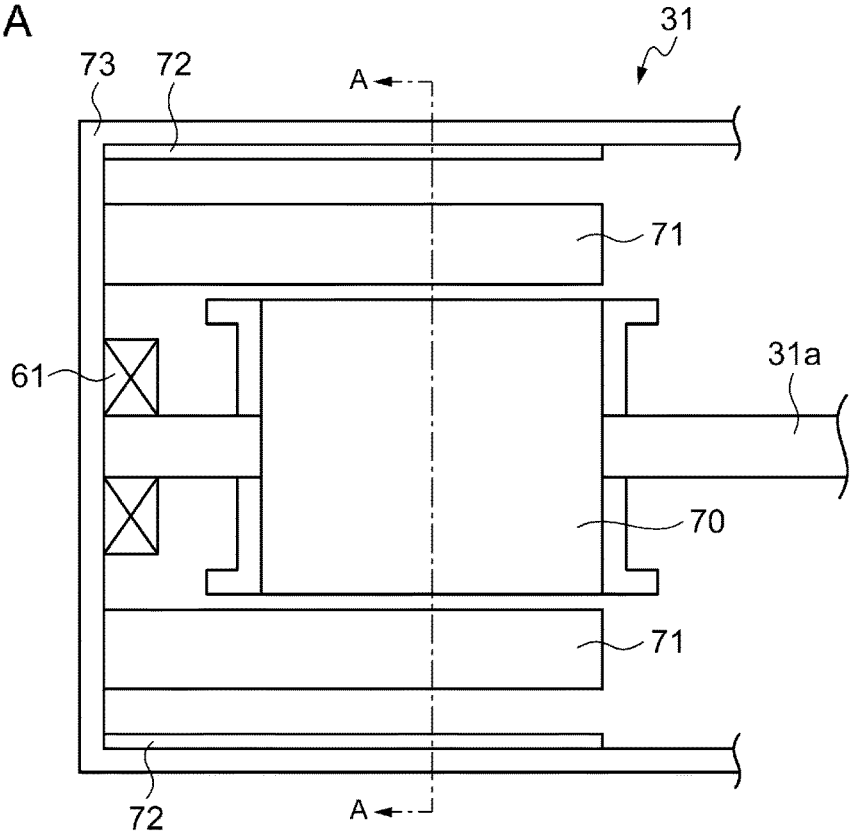
FIGS. 8A and 8B are diagrams illustrating a motor according to a modification of the embodiment.
Figure 8B:
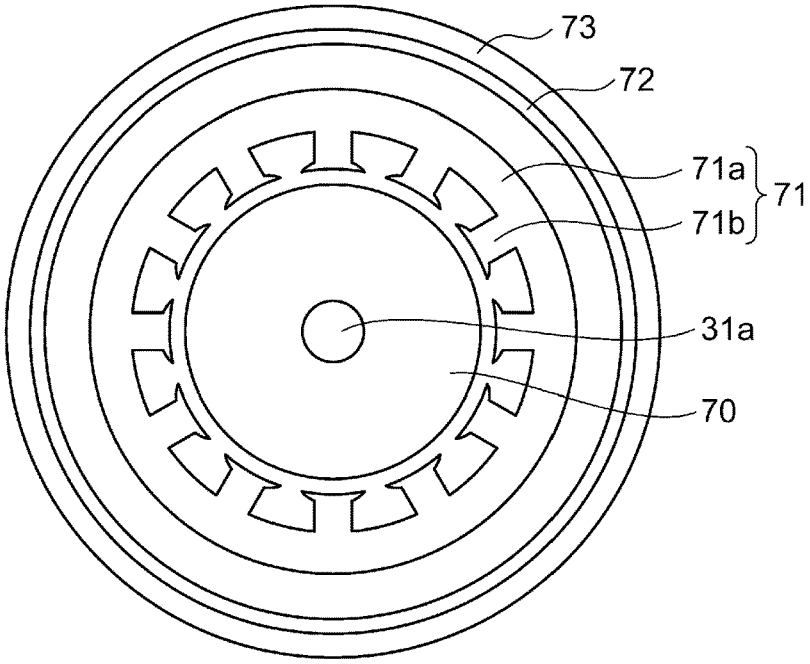

FIGS. 8A and 8B are diagrams illustrating a motor 31 according to a modification of the embodiment. Specifically, FIG. 8A is a diagram schematically illustrating the internal configuration of the motor 31 according to the modification. FIG. 8B is a diagram schematically illustrating the cross-section when the motor 31 according to the modification is cut out by a plane perpendicular to the driving rotary shaft 31*a*, and is a cross-sectional view taken along line A-A of FIG. 8A.

As shown in FIGS. 8A and 8B, the motor 31 according to the modification also includes a magnetic member 72. However, in the motor 31 according to the modification, the magnetic member 72 and the back yoke 71*a* are not directly connected to each other, unlike the motor 31 according to the embodiment. Instead, in the motor 31 according to the modification, the magnetic member 72 is connected to the back yoke 71*a* via the casing 73. Thereby, the back yoke 71*a* and the magnetic member 72 are fixed such that the relative position therebetween is unchanged. As compared to the motor 31 according to the embodiment, since the connecting member 76 is not present in the motor 31 according to the modification, the volume of the part where the low-pressure refrigerant gas exists is increased. Therefore, there is the effect that can further improve the performance of the GM refrigerator 10.

Second Modification

In the above, the two-stage GM refrigerator 10 has been described as an example of the cryogenic refrigerator. In addition, the present invention can be used in a single-stage GM refrigerator or a three-stage GM refrigerator. Also, the invention can also be applied to a case where a pulse tube refrigerator is used as the cryogenic refrigerator. That is, the motor may be adopted for the driving force of the valve that switches the flow passage of the low-pressure refrigerant gas and the flow passage of the high-pressure refrigerant gas. For example, in a case where such a pulse tube refrigerator is used for cooling of the superconducting coil, the magnetic field generated by the superconducting coil may influence the operation of the motor. In such a case, by adopting the motor 31 with the above-described magnetic member 72, it is possible to reduce the influence of the external magnetic field that is exerted to the driving force of the motor.

It should be understood that the invention is not limited to the above-described embodiment, but may be modified into various forms on the basis of the spirit of the invention. Additionally, the modifications are included in the scope of the invention.

What is claimed is:

1. A cryogenic refrigerator comprising:

a rotary valve that switches refrigerant-gas flows in the refrigerator between a low-pressure flow through a refrigerant-gas exhaust passage and a high-pressure flow through a refrigerant-gas supply passage; and a rotary-valve drive motor including a rotor, a driving rotary shaft penetrating the rotor, a stator surrounding the rotor, and a casing hermetically housing the rotor and the stator, the driving rotary shaft carried on a bearing in the casing, whereby the rotor is positioned radially inward of the stator;

wherein the stator includes a back yoke formed of laminated steel plates, and a steel magnetic member encompassing and radially spaced apart from the back yoke, and lining the casing, wherein the magnetic member acts as a magnetic path for external magnetic fields arising along the casing exteriorly.

2. The cryogenic refrigerator according to claim 1, wherein the back yoke and the magnetic member are fixed such that a relative position therebetween is unchanged.

3. The cryogenic refrigerator according to claim 1, wherein the magnetic member is fixed to the back yoke via connecting members.

4. The cryogenic refrigerator according to claim 1, wherein the laminated steel plates forming the back yoke are each a steel plate punched to constitute a layer of the back yoke integrally with a layer also constituting the magnetic member.

5. The cryogenic refrigerator according to claim 1, wherein the magnetic member is connected to the back yoke via the casing.

6. The cryogenic refrigerator according to claim 1, wherein a space that communicates with the flow passage of the low-pressure refrigerant gas is provided between the back yoke and the magnetic member.

7. The cryogenic refrigerator according to claim 1, wherein a non-magnetic material is filled between the back yoke and the magnetic member.

8. The cryogenic refrigerator according to claim 1, wherein a non-magnetic region is located radially outward of the back yoke and radially inward of the magnetic member.

9. The cryogenic refrigerator according to claim 1, wherein the laminated steel plates further form the magnetic member integrally with the back yoke.

10. The cryogenic refrigerator according to claim 1, wherein the laminated steel plates further form connecting members integrally with the back yoke, the connecting members directly connecting the magnetic member to the back yoke.

11. The cryogenic refrigerator according to claim 10, wherein the laminated steel plates further form the magnetic member integrally with the back yoke and the connecting members.

12. The cryogenic refrigerator according to claim 10, wherein non-magnetic regions are formed between the magnetic member and the back yoke, and circumferentially alternate with the connecting members.

13. The cryogenic refrigerator according to claim 10, wherein the connecting members radially extend from the back yoke to the magnetic member.

* * * * *